US006034519A

United States Patent [19]

Yang

[11] Patent Number: 6,034,519

[45] Date of Patent: Mar. 7, 2000

[54] INTERNAL SUPPLY VOLTAGE GENERATING CIRCUIT

[75] Inventor: Dong Jun Yang, Chungcheongbuk-do, Rep. of Korea

[73] Assignee: LG Semicon Co., Ltd., Chungcheongbuk-Do, Rep. of Korea

[21] Appl. No.: 09/201,805

[22] Filed: Dec. 1, 1998

[30] Foreign Application Priority Data

Dec. 12, 1997 [KR] Rep. of Korea ..... 97-68193

[51] Int. Cl.[7] ..... G05F 3/16

[52] U.S. Cl. ..... 323/316; 323/314

[58] Field of Search ..... 323/312, 313, 323/314, 315, 316, 907; 327/534, 535, 538, 539, 540

[56] References Cited

U.S. PATENT DOCUMENTS 4,723,108 2/1988 Murphy et al. ..... 323/315
4,733,162 3/1988 Haga et al. ..... 323/316
5,315,182 5/1994 Sakashita et al. ..... 307/482.1
5,581,174 12/1996 Fronen ..... 323/316
5,686,825 11/1997 Suh et al. ..... 323/316
5,783,935 7/1998 Kyung ..... 323/313
5,798,637 8/1998 Kim et al. ..... 323/313

*Primary Examiner*—Matthew Nguyen
*Attorney, Agent, or Firm*—Morgan, Lewis & Bockius LLP

[57] ABSTRACT

An internal supply voltage generating circuit includes a reference voltage generator for generating a reference voltage and an internal voltage level amplifier for amplifying the reference voltage to generate an internal voltage. The internal supply voltage generator also includes a variable process compensator for adjusting the internal voltage to compensate for a variance in the internal voltage generated during amplification of the reference voltage by the internal level amplifier. The internal supply voltage further includes a driver for generating an internal supply voltage based on the internal voltage.

20 Claims, 2 Drawing Sheets

INTERNAL SUPPLY VOLTAGE GENERATING CIRCUIT

This application claims the benefit of Korean Application No. 68193/1977 filed Dec. 12, 1997, which is hereby incorporated by reference.

BACKGROUND OF THE INVENTION

1. Field of the Invention

The present invention relates to an internal supply voltage generating circuit, and more particularly, to an internal supply voltage generating circuit with improved reliability despite variable fabrication process steps.

2. Discussion of the Related Art

Generally, a stable voltage at a specific node in a circuit is required for an internal power source. In this case, it is necessary to lower an AC impedance of the node and stabilize the DC voltage level at the node. Since it is difficult to satisfy these two requirements at the same time, only one of these requirements is typically satisfied. For example, the internal power source may be based on the low impedance. A reference voltage generator provides a stable voltage against variable external temperature or variable external voltage. To ensure an excellent internal power source, the low impedance and the reference voltage generator should be considered in designing the internal power source.

Meanwhile, to design a reference voltage generator which provides a stable reference voltage regardless of the variable external voltage and the variable external temperature, the reference voltage should be based on a physical constant. Typical examples of the reference voltage are a built-in voltage of a PN junction and a threshold voltage of a MOS structure.

The built-in voltage and the threshold voltage are suitable for use as the reference voltage. Due to their rare design variables, these voltages depend on process conditions rather than the size of a given device. It is therefore essential that the effect of a temperature variable, i.e., the temperature coefficient, is minimized in designing peripheral circuits. In this respect, various circuits have been proposed.

In one circuit, a reference voltage, which is not affected by the variable external voltage, the variable external temperature, and the variable process steps, is generated. If the internal supply voltage is varied, the varied voltage is detected so that feedback is performed at high speed in response to the detected voltage, thereby reducing the variance of the internal supply voltage. Therefore, the internal power source voltage circuit requires a stable reference voltage generator, a high speed feedback loop, and high capacity current supply ability.

A related internal supply voltage generating circuit will be described with reference to FIG. 1. The internal supply voltage generating circuit shown in FIG. 1 includes a reference voltage generator for generating a reference voltage $V_{ref}$ from an external supply voltage $V_{cc}$, an internal voltage level amplifier for amplifying the reference voltage generated by the reference voltage generator to generate an internal voltage $V_{LR}$, and a driver 30 for driving the internal supply voltage $V_{dd}$ by the value amplified by the internal voltage level amplifier 20.

The reference voltage generator 10 generates a stable reference voltage regardless of fluctuations in the external supply voltage Vcc. The reference voltage generator 10 includes first and second NMOS transistors 11 and 12 having a gate in common, and a resistor 13 having one end connected to a source of the second nMOS transistor 12 and the other end connected to Vss. The reference voltage generator 10 also includes a first pMOS transistor 14 having a drain connected to the common gate of the first and second nMOS transistors 11 and 12, and having a source connected to $V_{cc}$. The reference voltage generator 10 further includes a second pMOS transistor 15 having a source connected to Vcc and a drain connected to the source of the second nMOS transistor 12. The gates of the first and second pMOS transistors 14 and 15 are connected to each other. The common gate of the first and second pMOS transistors 14 and 15 is connected to a drain terminal of the second pMOS transistor 15 and provides a reference voltage $V_{ref}$.

In the aforementioned reference voltage generator 10, since the first and second pMOS transistors 14 and 15 use the gate in common, current which flows through the first pMOS transistor 14 is the same as that which flows through the second pMOS transistor 15 in a saturation region.

The internal voltage level amplifier 20 includes four pMOS transistors 16, 17, 18, and 19 connected in series between Vcc and Vss. A third pMOS transistor 16 has a gate connected to the reference voltage node of the reference voltage generator 10 and a source terminal connected to $V_{cc}$. A fourth pMOS transistor 17 has a source terminal connected to a drain terminal of the third pMOS transistor 16 and a drain terminal connected to its own gate. A fifth pMOS transistor 18 has a source terminal connected to the drain terminal of the fourth pMOS transistor 17 and a drain terminal connected to its own gate. A sixth pMOS transistor 19 has a source terminal connected to the drain terminal of the fifth pMOS transistor 18, and a drain terminal connected to its own gate and to Vss.

The node connecting the drain terminal of the third pMOS transistor 16 and the source terminal of the fourth pMOS transistor 17 is the output node of the internal voltage level amplifier 20 providing the internal voltage $V_{LR}$.

The driver 30 includes a comparator 21 for detecting a voltage difference between the internal voltage $V_{LR}$ output from the output node of the internal voltage level amplifier 20 and the internal supply voltage Vdd. The driver 30 also includes a seventh pMOS transistor 22 having a gate connected to the output of the comparator 21 and a source connected to Vcc. The driver 30 further includes a third nNMOS transistor 23 having a drain connected to the drain of the seventh pMOS transistor 22 and a source connected to Vss. The seventh pMOS transistor 22 and the third nMOS transistor 23 have the common drain which provides the internal supply voltage $V_{dd}$, which is also fed back to an input of the comparator 21.

In the reference voltage generator 10 of the internal supply voltage generating circuit shown in FIG. 1, the current which flows in the gate of the first pMOS transistor 14 can be expressed as $$V_{GS1}=V_{GS2}+I\cdot R, \qquad \text{(Equation 1)}$$

where $V_{GS1}$ is the voltage across the gate and source of the first NMOS transistor 11, and $V_{GS2}$ is the voltage across the gate and source of the second nMOS transistor 12. Since the first pMOS transistor 14 and the second pMOS transistor 15 are formed by the same process steps, the following equation can be obtained.

$$k = \mu co_x \frac{W}{L}, \quad \text{(Equation 2)}$$

In this case, the current which flows to the common gate from the saturation region can be expressed as follows.

$$I \cdot R = V_{GS1} - V_{GS2} = V_{T1} + \sqrt{\frac{I}{k_1}} - \left(V_{T2} + \sqrt{\frac{I}{k_2}}\right), \quad \text{(Equation 3)}$$

$$\text{wherein, } (V_{T1} = V_{T2}) = \sqrt{I}\left(\frac{1}{\sqrt{k_1}} - \frac{1}{\sqrt{k_2}}\right)$$

$V_{T1}$ and $V_{T2}$ represent threshold voltages for the first and second riMOS transistors 11 and 12, respectively.

Therefore, the following equation is obtained.

$$I^{\frac{1}{2}} = \frac{1}{R}\left(\frac{1}{\sqrt{k_1}} - \frac{1}{\sqrt{k_2}}\right) \quad \text{(Equation 4)}$$

As a result, a current which has no relation to the external power source Vcc flows. Meanwhile, the following equations are obtained.

$$V_{REF} = V_{CC} - V_{GS4} = V_{CC} - |V_{TP4}| - \sqrt{\frac{I}{k}} \quad \text{(Equation 5)}$$

$$= V_{CC} - |V_{TP4}| - \frac{1}{R\sqrt{k_4}\left(\sqrt{k_1} - \sqrt{k_2}\right)}$$

$$k = \mu co_x \frac{W}{L}, \quad \text{(Equation 6)}$$

$$\alpha = \frac{1}{R\sqrt{k_4}\left(\sqrt{k_1} - \sqrt{k_2}\right)}$$

$V_{GS4}$ represents a voltage across the gate and source of the second pMOS transistor 15. $V_{TP4}$ represents the threshold voltage for the second pMOS transistor 15.

Therefore, the internal voltage $V_{LR}$ is expressed as $$V_{LR}=3(|V_{tp}|+\alpha), \quad \text{(Equation 7)}$$

where $V_{tp}$ represents a threshold voltage for each of the fourth, fifth, and sixth pMOS transistors 17, 18, and 19.

The internal voltage $V_{LR}$ is generated by amplifying $V_{tp}$, which may vary depending on the fabrication process variables and conditions, three times. Accordingly, the internal voltage $V_{LR}$ depends on the variables of the process steps. The driver 30 functions to keep the internal supply voltage $V_{dd}$ at the same level as that of the internal voltage $V_{LR}$.

The above internal voltage generating circuit has several problems. First, the internal supply voltage level depends on the manufacturing process steps, in particular, burn-in process steps. Since it is impossible to perform exact burn-in process, reliability of a manufactured chip is reduced. In addition, to adjust the internal supply voltage level, a trimming circuit is additionally required.

SUMMARY OF THE INVENTION

Accordingly, the present invention is directed to an internal voltage generating circuit that substantially obviates one or more of the problems due to limitations and disadvantages of the related art.

An object of the present invention is to provide an internal voltage generating circuit in which internal voltage level is uniformly maintained by compensating variable of the process steps so as to improves reliability of a chip.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an internal supply voltage generating circuit for use in a semiconductor device includes a reference voltage generator for generating a reference voltage, an internal voltage level amplifier for amplifying the reference voltage to generate an internal voltage, a variable process compensator for adjusting the internal voltage to compensate for a variance in the internal voltage generated during amplification of the reference voltage by the internal level amplifier, and a driver for generating an internal supply voltage based on the internal voltage.

In another aspect of the present invention, an internal supply voltage generating circuit for use in a semiconductor device includes a reference voltage generator for generating a reference voltage, an internal voltage generator for generating an internal voltage according to the reference voltage, a feedback circuit for keeping the internal voltage substantially constant, and a driver for generating an internal supply voltage based on the internal voltage.

In another aspect of the present invention, an internal supply voltage generating circuit for use in a semiconductor device includes a reference voltage generator for generating a reference voltage; an internal voltage generator for generating an internal voltage according to the reference voltage and generating a variable voltage, the variable voltage being dependant on process variables and conditions during fabrication of the semiconductor device; a feedback circuit for keeping the internal voltage substantially constant, the feedback circuit including a first transistor and a resistor, and the variable voltage being applied to the gate of the first transistor; and a driver for generating an internal supply voltage based on the internal voltage. The driver includes a comparator for comparing the internal voltage and the internal supply voltage, and second and third transistors connected in series between $V_{cc}$ and $V_{ss}$. The second transistor has a gate connected to an output of the comparator, The driver generates the internal supply voltage at a node between the second and third transistors.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
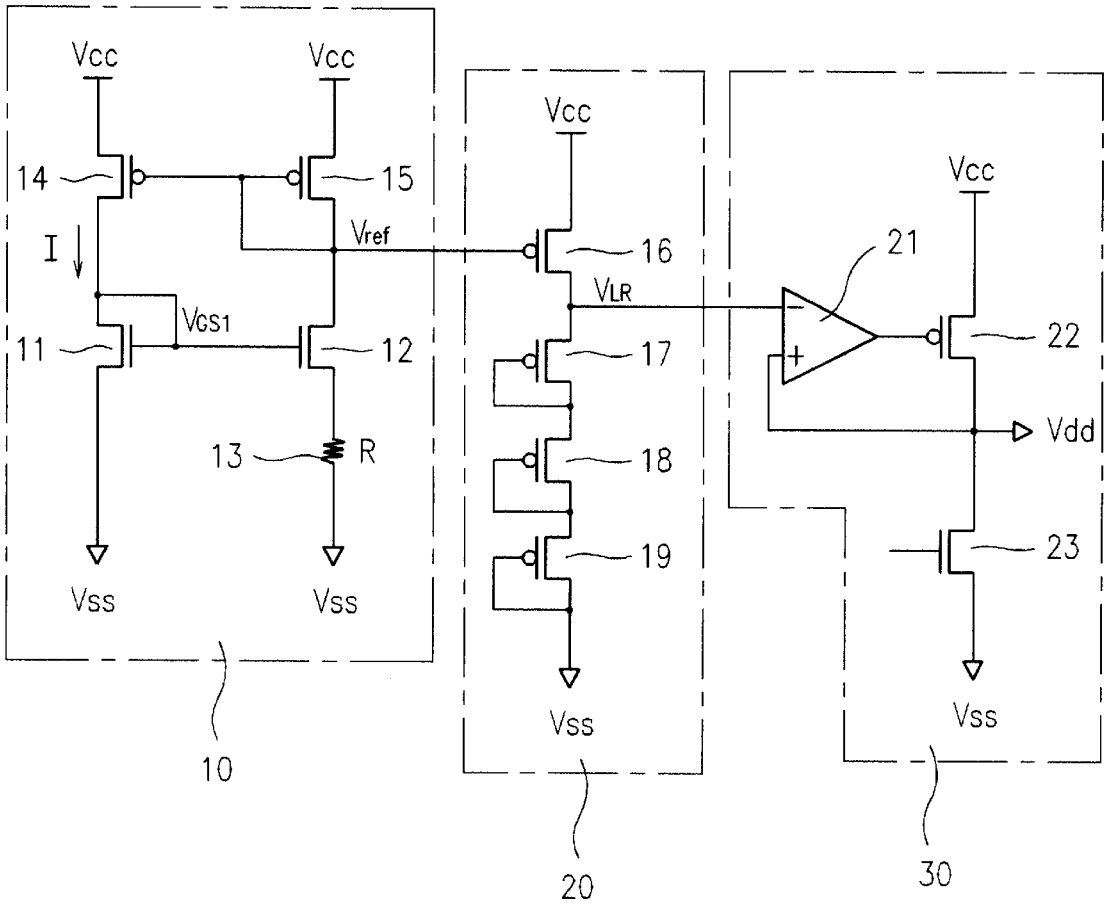
FIG.1 background art
FIG. 1 is a circuit diagram illustrating a related internal voltage generating circuit discussed in the Background.
Figure 2:
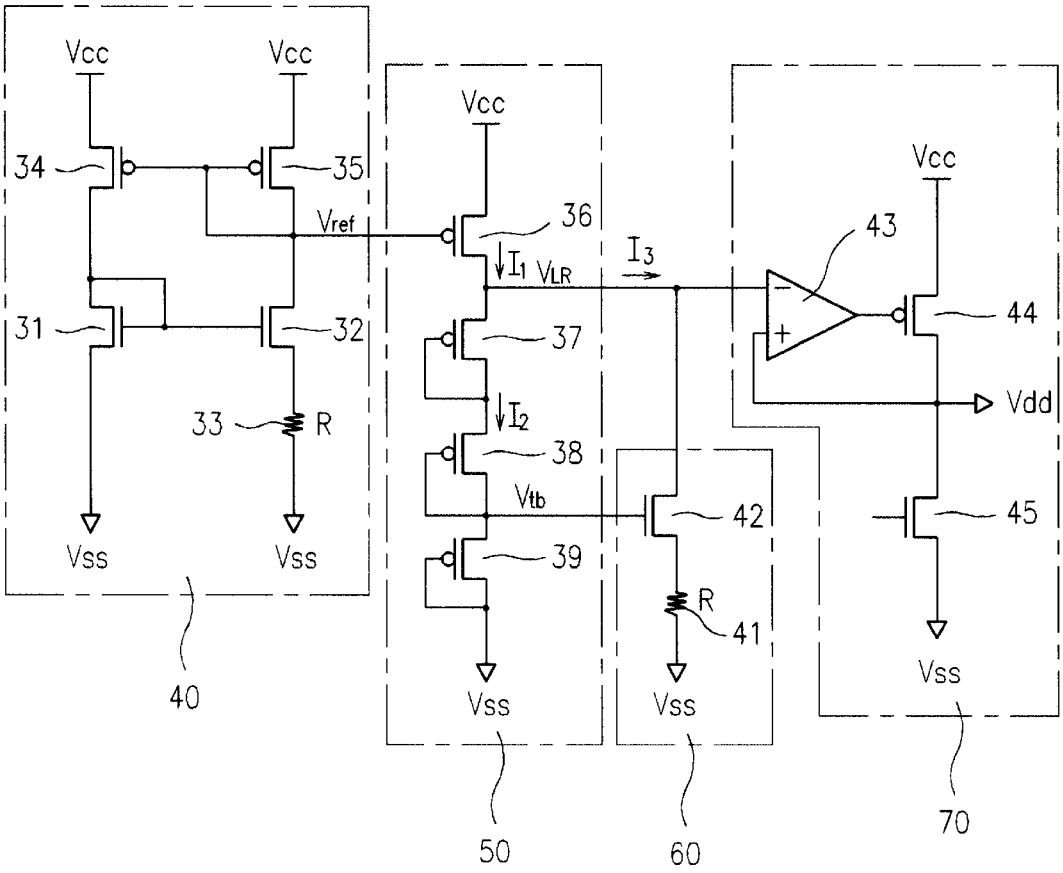
FIG. 2 is a circuit diagram illustrating an internal voltage generating circuit according to the present invention.

As shown in FIG. 2, an internal supply voltage generating circuit according to the present invention includes a reference voltage level generator 40 for generating a reference voltage $V_{ref}$ from an external supply voltage Vcc, an internal voltage level amplifier 50 for amplifying the reference voltage $V_{ref}$ to generate an internal voltage $V_{LR}$. A variable process compensator 60 compensates for variable process due to the amplification of the reference voltage $V_{ref}$ in generating the internal voltage $V_{LR}$ by the internal voltage level amplifier 50. A driver 70 generates the internal supply voltage $V_{dd}$ from the internal voltage $V_{LR}$.

The reference voltage generator 40 generates a stable reference voltage regardless of fluctuations in the external supply voltage Vcc. The reference voltage generator 40 includes first and second nMOS transistors 31 and 32 having a common gate. The first resistor 33 is connected in series between a source terminal of the second nMOS transistor 32 and Vss. The reference voltage generator 40 also includes a first pMOS transistor 34 having a drain terminal connected to the common gate for the first and second nMOS transistors 31 and 32. The reference voltage generator 40 includes a second pMOS transistor 35 having a source terminal connected to Vcc. The second pMOS transistor 35 has a gate in common with the first pMOS transistor 34. The common gate for the first and second pMOS transistors 34 and 35 is connected to a drain terminal of the second pMOS transistor 35 to form an output node of the reference voltage generator 40 having reference voltage $V_{ref}$.

In the reference voltage generator 40, since the first and second pMOS transistors 34 and 35 use the gate in common, current which flows through the first pMOS transistor 34 is the same as that which flows through the second pMOS transistor 35 in a saturation region.

The internal voltage level amplifier 50 includes third, fourth, fifth, and sixth pMOS transistors 36, 37, 38, 39 connected in series between Vcc and Vss. The third pMOS transistor 36 has a gate connected to the output node of the reference voltage generator 40 and a source terminal connected to Vcc. The fourth pMOS transistor 37 has a source terminal connected to a drain terminal of the third pMOS transistor 36 and a drain terminal connected to its own gate. The fifth pMOS transistor 38 has a source terminal connected to the drain terminal of the fourth pMOS transistor 37 and a drain terminal connected to its own gate. The sixth pMOS transistor 39 has a source terminal connected to the drain terminal of the fifth pMOS transistor 38, and a drain terminal connected to its own gate and to Vss.

The common node connecting the drain terminal of the third pMOS transistor 36 and the source terminal of the fourth pMOS transistor 37 is the output node of the internal voltage level amplifier 50 having internal voltage $V_{LR}$. Also, the internal voltage level amplifier 50 generates a variable voltage $V_{tb}$ at the common node connecting the drain terminal of the fifth pMOS transistor 38 and the sixth PMOS transistor. The variable voltage $V_{tb}$ depends on fabrication process variables and conditions.

The variable process compensator 60 includes a third nMOS transistor 42 having a drain terminal connected to the output terminal of the internal voltage level amplifier 50 and a source terminal connected to $V_{ss}$ through the second resistor 41. The variable voltage $V_{tb}$ generated by the internal voltage level amplifier is applied to the gate of the third nMOS transistor 42.

The variable process compensator 60 can be expressed as follows.

$$I_1 = I_2 + I_3 \quad \text{(Equation 8)}$$

$$V_{LR} = 3 \cdot \left( |Vtb| + \sqrt{\frac{I_1 - I_3}{K}} \right) \quad \text{(Equation 9)}$$

$V_{tb}$ varies from device to device depending on fabrication process conditions and variables. However, if $|V_{tb}|$ is high, the value of $I_3$ becomes larger by means of the third nMOS transistor 42. If $|V_{tb}|$ is low, the value of $I_3$ becomes smaller by means of the third niMOS transistor 42. Therefore, the variable process compensator 60, including the third nMOS transistor 42 and the second resistor 41, functions as a feedback circuit to keep the internal voltage $V_{LR}$ substantially constant despite variances in $|V_{tb}|$. Since the third nMOS transistor 42 has a low threshold voltage to detect even a small variation in $V_{tb}$, it is possible to compensate for the fabrication process variables and conditions which may cause $|V_{tb}|$ to vary from device to device.

The driver 70 includes a comparator 43 for detecting voltage difference between the internal voltage $V_{LR}$ output from the output node of the internal voltage level amplifier 50 and the output voltage $V_{dd}$. The driver 70 also includes a seventh pMOS transistor 44 having a gate connected to the output of the comparator 43 and a source terminal connected to Vcc. The driver 70 includes a third nMOS transistor 45 having a drain terminal connected to a drain terminal of the seventh pMOS transistor 44 and a source terminal connected to Vss. The operation of the driver 70 is as follows. If an overcurrent flows to the load from the $V_{dd}$ terminal, $V_{dd}$ temporarily decreases. At this time, if $V_{dd}$ becomes lower than $V_{LR}$, the gate voltage of the seventh pMOS transistor 44 decreases by means of the operation of the comparator 43 so that the seventh pMOS transistor 44 is turned on. Then, the current is supplied to the load, and thus $V_{dd}$ starts to increase.

If $V_{dd}$ becomes greater than $V_{LR}$, the gate voltage of the seventh pMOS transistor 44 increases so that the seventh pMOS transistor 44 is turned off, and $V_{dd}$ stops increasing.

The length of a period during which the gate voltage of the seventh pMOS transistor 44 decreases is substantially proportional to that of a period during which $V_{dd}$ decreases. In addition, since a relatively large size of the seventh pMOS transistor 44 allows a fast current flow through it, the period during which $V_{dd}$ decreases is kept short according to the fast current flow.

The seventh pMOS transistor 44 and the third nMOS transistor 45 use the drain terminal in common. The voltage at the common drain terminal is the internal supply voltage $V_{dd}$, which is also fed back to the comparator 43.

The internal supply voltage generating circuit of the present invention has the following advantages. First, fabrication process variables and conditions cause variances in the internal voltage, thus variances in the internal supply voltage. The variances in the internal voltage, generated when amplifying the reference voltage to the internal voltage level, is compensated by the variable process compensator so as to maintain a stable internal voltage, thus a stable internal supply voltage. Hence, reliability of a chip is improved. In addition, the variable process compensator obviates the need for a trimming circuit which uniformly maintains the internal supply voltage.

It will be apparent to those skilled in the art that various modifications and variations can be made in the internal supply voltage generating circuit according to the present invention without departing from the spirit or scope of the invention. Thus, it is intended that the present invention covers the modifications and variations of the invention provided they come within the scope of the appended claims and their equivalents.

What is claimed is:

1. An internal supply voltage generating circuit for use in a semiconductor device, said internal supply voltage generating circuit comprising:

a reference voltage generator for generating a reference voltage;

an internal voltage level amplifier for amplifying said reference voltage to generate an internal voltage;

a variable process compensator for adjusting said internal voltage to compensate for a variance in said internal voltage generated during amplification of said reference voltage by said internal voltage level amplifier; and a driver for generating an internal supply voltage based on said internal voltage.

2. The internal supply voltage generating circuit as claimed in claim 1, wherein said reference voltage is substantially constant regardless of variances in an external voltage supplied to said reference voltage generator.

3. The internal supply voltage generating circuit as claimed in claim 1, wherein said reference voltage generator includes:

first and second nMOS transistors having a gate in common;

a first resistor connected in series between a source terminal of said second nMOS transistor and ground voltage Vss;

a first pMOS transistor having a drain terminal connected to a node of the gate; and a second pMOS transistor having a source terminal connected to an external supply voltage Vcc and a gate in common with said first pMOS transistor.

4. The internal supply voltage generating circuit as claimed in claim 3, wherein substantially the same amount of current flows through said first and second pMOS transistors of said reference voltage generator.

5. The internal supply voltage generating circuit as claimed in claim 1, wherein said variable process compensator is a feedback circuit.

6. The internal supply voltage generating circuit as claimed in claim 5, wherein said internal voltage level amplifier also generates a variable voltage, said variable voltage being dependant on process variables and conditions in fabricating said semiconductor device, and said feedback circuit includes a third nMOS transistor and a second resistor, said third nMOS transistor having a drain terminal receiving said internal voltage and a gate receiving said variable voltage, and said second resistor being connected between a source terminal of said third nMOS transistor and ground voltage Vss.

7. The internal supply voltage generating circuit as claimed in claim 6, wherein said third nMOS transistor has a low threshold voltage.

8. The internal supply voltage generating circuit as claimed in claim 1, wherein said internal voltage level amplifier includes:

a third pMOS transistor having a gate connected to an output node of said reference voltage generator and a source terminal connected to an external supply voltage Vcc;

a fourth pMOS transistor having a source terminal connected to a drain terminal of said third pMOS transistor and a drain terminal connected to its own gate;

a fifth pMOS transistor having a source terminal connected to said drain terminal of said fourth pMOS transistor and a drain terminal connected to its own gate; and a sixth pMOS transistor having a source terminal connected to said drain terminal of said fifth pMOS transistor and a drain terminal connected to its own gate and to ground voltage Vss.

9. The internal supply voltage generating circuit as claimed in claim 8, wherein said internal voltage level amplifier generates said internal voltage at a common node between said drain terminal of said third pMOS transistor and said source terminal of said fourth pMOS transistor.

10. The internal supply voltage generating circuit as claimed in claim 1, wherein said driver includes:

a comparator for comparing said internal voltage output from said internal voltage level amplifier and said internal supply voltage;

a seventh pMOS transistor having a gate connected to the output of said comparator and a source terminal connected to an external supply voltage Vcc; and a fourth nMOS transistor having a drain terminal connected to a drain terminal of said seventh pMOS transistor and a source terminal connected to ground voltage Vss.

11. The internal supply voltage generating circuit as claimed in claim 10, wherein a common node between said drain of said seventh pMOS transistor and said drain of said fourth nMOS transistor are connected in common to an input of said comparator.

12. An internal supply voltage generating circuit for use in a semiconductor device, said internal supply voltage generating circuit comprising:

a reference voltage generator for generating a reference voltage;

an internal voltage generator for generating an internal voltage according to said reference voltage;

a feedback circuit for keeping said internal voltage substantially constant; and a driver for generating an internal supply voltage based on said internal voltage.

13. The internal supply voltage generator as claimed in claim 12, wherein said reference voltage is substantially constant regardless of variances in an external voltage supplied to said reference voltage generator.

14. The internal supply voltage generator as claimed in claim 12, wherein said internal voltage generator also generates a variable voltage, said variable voltage being dependant on process variables and conditions during fabrication of said semiconductor device.

15. The internal supply voltage generator as claimed in claim 14, wherein said feedback circuit includes a first transistor and a second resistor, and said variable voltage is applied to the gate of said first transistor.

16. The internal supply voltage generator as claimed in claim 14, wherein said internal voltage generator includes second, third, fourth, and fifth transistors connected in series between an external supply voltage Vcc and ground voltage Vss, said internal voltage generator generates said internal voltage at a node connecting said second and third transistors, and said internal voltage generator generates said variable voltage as a node connecting said fourth and fifth transistors.

17. The internal supply voltage generator as claimed in claim 12, wherein said driver includes:

a comparator for comparing said internal voltage and said internal supply voltage; and a sixth transistor having a gate connected to an output of said comparator.

18. The internal supply voltage generator as claimed in claim 17, wherein said driver further includes a seventh transistor having a source terminal connected to ground voltage Vss, said sixth transistor having a source terminal connected to an external supply voltage $V_{cc}$ and a drain terminal being connected to a drain terminal of said seventh transistor.

19. The internal supply voltage generator as claimed in claim 18, wherein said driver generates said internal supply voltage at a node between said drain terminals of said sixth and seventh transistors.

20. An internal supply voltage generating circuit for use in a semiconductor device, said internal supply voltage generating circuit comprising:

a reference voltage generator for generating a reference voltage;

an internal voltage generator for generating an internal voltage according to said reference voltage and generating a variable voltage, said variable voltage being dependant on process variables and conditions during fabrication of said semiconductor device;

a feedback circuit for keeping said internal voltage substantially constant, said feedback circuit including a first transistor and a resistor, and said variable voltage being applied to the gate of said first transistor; and a driver for generating an internal supply voltage based on said internal voltage, wherein said driver includes a comparator for comparing said internal voltage and said internal supply voltage, and second and third transistors connected in series between Vcc and Vss, said second transistor having a gate connected to an output of said comparator, wherein said driver generates said internal supply voltage at a node between said second and third transistors.

* * * * *